United States Patent [19]

Munn

[11] 4,161,234

[45] Jul. 17, 1979

[54] SERVING CART

[76] Inventor: Clyde Munn, 203 Huckleberry Dr., Cheraw, S.C. 29520

[21] Appl. No.: 885,981

[22] Filed: Mar. 13, 1978

[51] Int. Cl.[2] ..... E04H 3/04

[52] U.S. Cl. ..... 186/1 R; 312/306

[58] Field of Search ..... 186/1 R, 1 B, 1 D, 7, 186/26, 27, 1 AF, 1 AT; 312/306, 290, 71, 97; 296/22; 126/268; 219/214, 218, 202

[56] References Cited

U.S. PATENT DOCUMENTS

| | | | |
|---|---|---|---|
| 2,319,613 | 5/1943 | Lichtstern | 312/306 |
| 2,707,665 | 5/1955 | Ford | 312/290 |
| 2,812,227 | 11/1957 | Hill | 312/306 |
| 2,875,012 | 2/1959 | Riley | 312/306 |
| 3,997,028 | 12/1976 | Lopez | 186/1 D |

FOREIGN PATENT DOCUMENTS

| | | | |
|---|---|---|---|
| 460371 | 11/1950 | Italy | 312/306 |

*Primary Examiner*—Reinhard J. Eisenzopf
*Attorney, Agent, or Firm*—C. Gordon McBride

[57] ABSTRACT

A serving cart, including a wheel mounted housing, is provided with a serving top having a series of openings therethrough for the selective projection of bottles and the like carried by an internal shelf. The shelf is power driven so as to selectively raise and lower relative to the top. A pair of leaves are hinged to opposite sides of the top and selectively overlie the top or project laterally outward therefrom.

2 Claims, 6 Drawing Figures

SERVING CART

BACKGROUND OF THE INVENTION

The invention herein is basically concerned with a serving cart. While such carts are of course well known and perform a highly desirable function in facilitating the transporting of foods, refreshments, and the like from a point of preparation or storage to the area in which the goods are to be served, the carts heretofore known do have certain deficiencies.

More particularly, inasmuch as the conventional serving cart will normally be moved from room to room, or along hallways and the like, there are certain limitations on the width of the cart. This in turn restricts the serving area provided thereon. Further, the conventional serving cart, having only planar support surfaces including the flat serving top and one or more shelves, provides little stable support for bottles and the like during movement of the cart from one location to another, particularly if the cart is to be rolled any great distance.

SUMMARY OF THE INVENTION

The present invention proposes overcoming the above noted deficiencies. Accordingly, one significant feature of the present invention is to provide a serving cart which is uniquely adapted to receive, stabilize and selectively position bottles, containers, and the like in a manner whereby no difficulty is encountered in the carrying of such articles on the serving cart during the movement of the cart from one area to another.

In conjunction with the secure retention of articles such as bottles and the like, the present invention proposes means whereby such articles can be automatically moved from an internal storage position to an exposed position for use.

The above features are basically derived from a power controlled vertically shiftable inner shelf which incorporates pockets for the reception of the base portions of the various articles whereby a shifting or sliding thereof is precluded. In addition, the serving top of the cart is provided with openings aligned with the pockets whereby, upon elevating of the shelf, the various articles will be projected upward through the serving top for ready access thereto.

The present invention also proposes means for the selective increase of the upper work surface of the cart. This is effected by means of a pair of side leaves which move from a compact storage position overlying the serving top to an extended position generally coplanar with the serving top. The leaves, in the extended position thereof, are stabilized by underlying sliding support bars. In the stored position, the leaves provide a solid support surface coextensive with and overlying the apertured serving top.

DESCRIPTION OF THE PREFERRED EMBODIMENT

Figure 1:
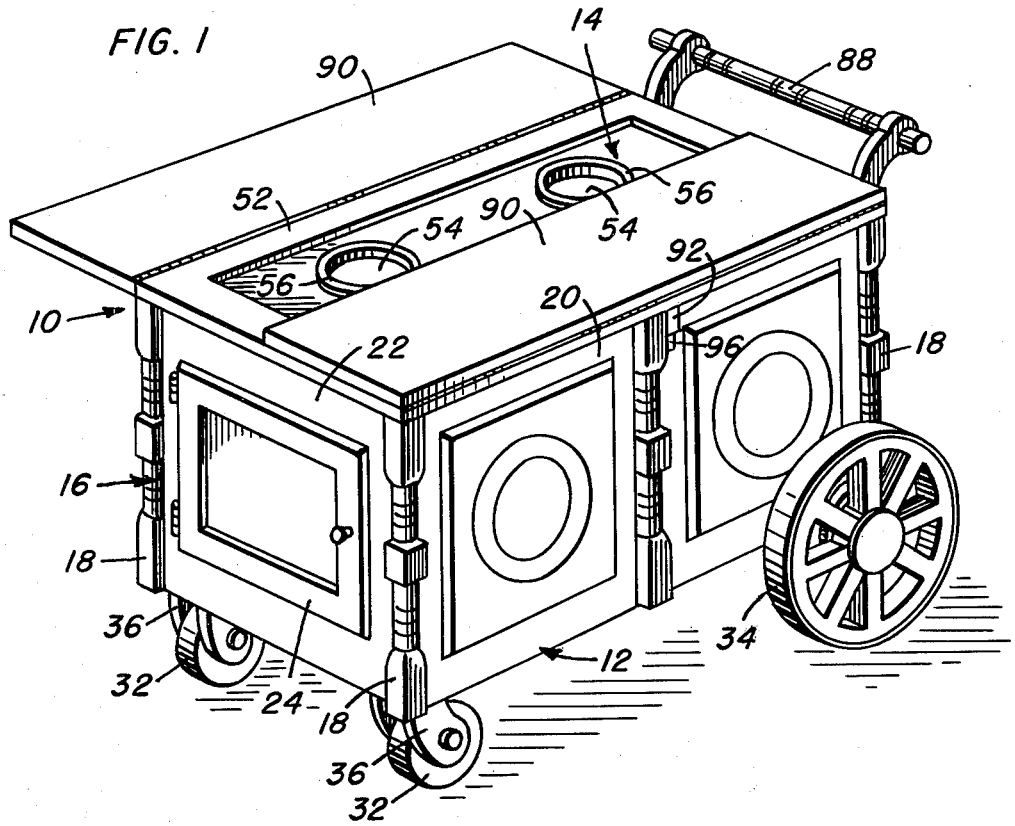
FIG. 1 is a perspective view of the serving cart of the present invention with one leaf extended and one leaf folded.
Figure 6:
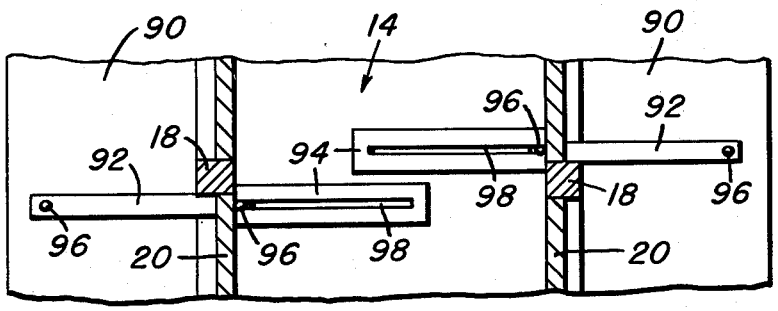
FIG. 6 is a partial bottom view taken substantially on line 6—6 of FIG. 3.

Referring now specifically to the drawings, the serving cart 10 consists basically of a wheel supported base section 12, a serving top 14 positioned vertically thereabove, and a housing or cabinet 16 extending therebetween.

The housing 16 includes vertically extending supports or legs 18 and both side panels 20 and end panels 22. Access to the interior of the cart housing, and the storage areas therein, will normally be provided through the two end panels by hinge mounted doors 24.

The base or base section 12 includes a horizontal base panel 26 with side and end wall sections 28 and 30 depending respectively from the sides and ends thereof so as to constitute support beams. These depending base wall sections, as illustrated, can constitute the lower ends of the side and end panels 20 and 22.

The wheel mounts for the cart include front caster steering wheels 32 and rear fixed axle enlarged wheels 34. The caster wheels 32 each include a yoke 36 which mounts the wheel, and a vertically extending shaft 38 received through a bushing 40 provided within an overlying cross beams 42. Each yoke 36 is preferably of wood with the offset being ⅛ inch horizontal to 1 inch vertical and with the wood grain running vertical. The cross beam 42 extends between the opposed side wall sections 28 adjacent the forward end wall 30, and is appropriately mounted and positioned by spacer blocks 44 provided adjacent the inner faces of the opposed side wall sections 28 and extending vertically between the upper surface of the cross beam 42 and the overlying base panel 26. The provision of such caster wheels 32 at the front of the serving cart allows for a free swinging and steering of the cart.

The enlarged rear wheels 34 are positioned immediately outward of the opposed sides of the base portion of the cart 10 toward the rear thereof. Each of these enlarged rear wheels 34 includes a bushing 47 which receives a fixed projecting shaft 48 extending through and between a pair of spaced blocks 50 affixed to and under the base portion or section 12 of the cart 10 for rotation of the wheel about the shaft.

Turning now to the upper portion of the cart 10, it will be noted that the serving top 14 is provided with a relatively low upstanding rim 52 thereabout so as to provide both a finished surface and a retaining means for glasses and the like. In addition, a series of various size openings 54 are provided through the serving top, these openings also being surrounded by rims 56 which are primarily for the same purpose as the aforementioned rim 52.

The openings 54 are particularly intended so as to enable the upward projection therethrough of articles, primarily bottles, ice buckets, and the like. These articles will be carried by an internal, vertically adjustable, shelf 58 which can be selectively raised so as to expose the articles for use, and selectively lowered so as to position the articles in a secure stored position within the housing portion 16 of the cart 10.

Figure 2:
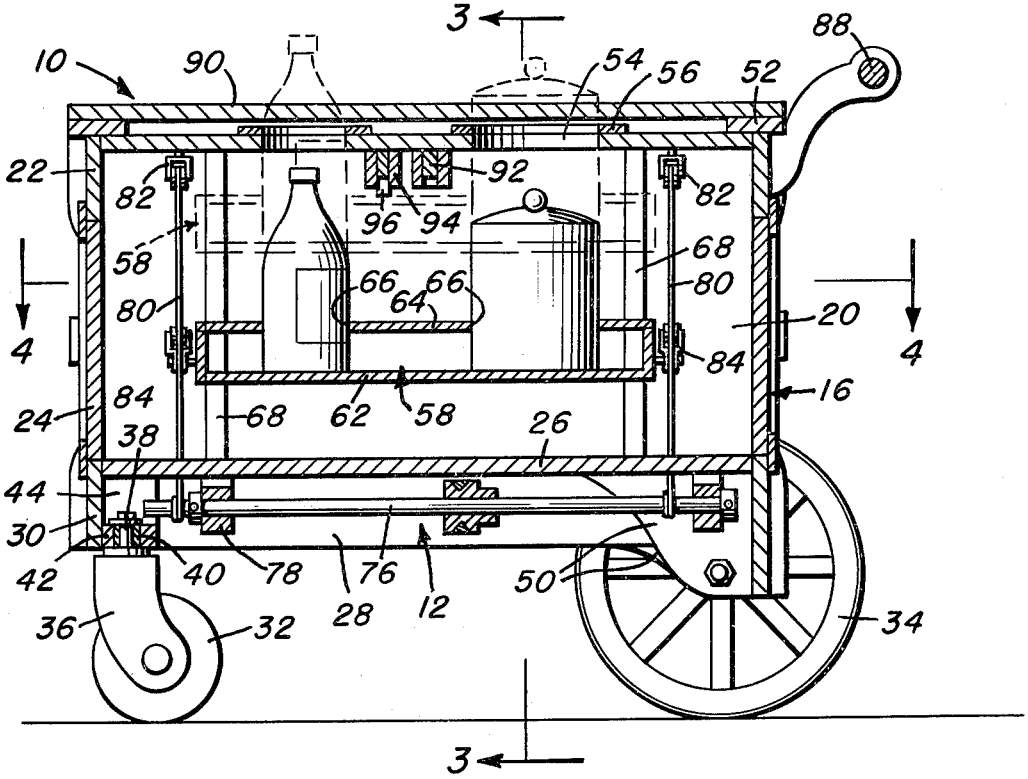
FIG. 2 is a longitudinal cross-sectional view through the cart.
Figure 3:
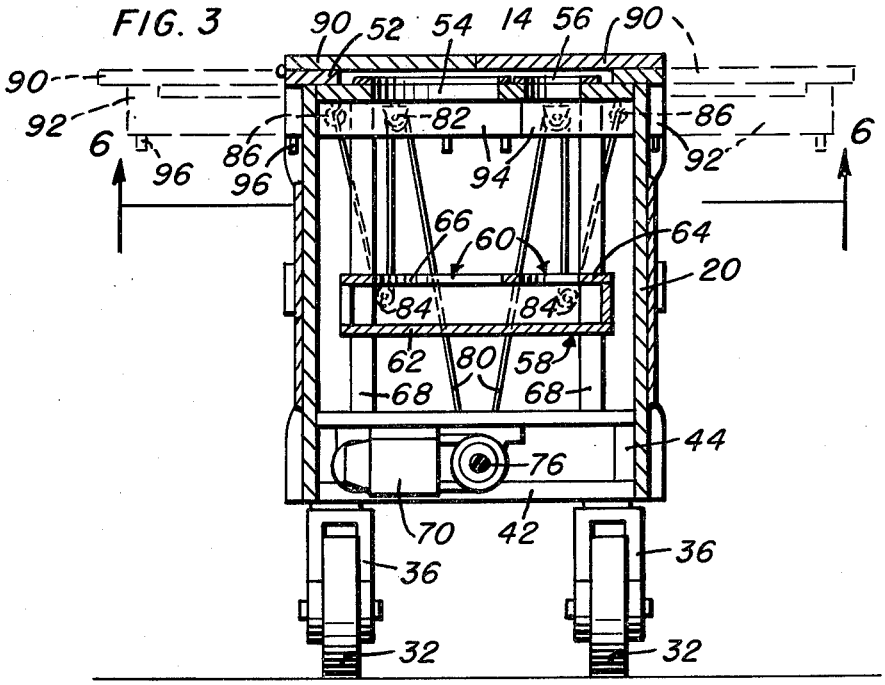
FIG. 3 is a transverse sectional view taken substantially on line 3—3 of FIG. 2.
Figure 4:
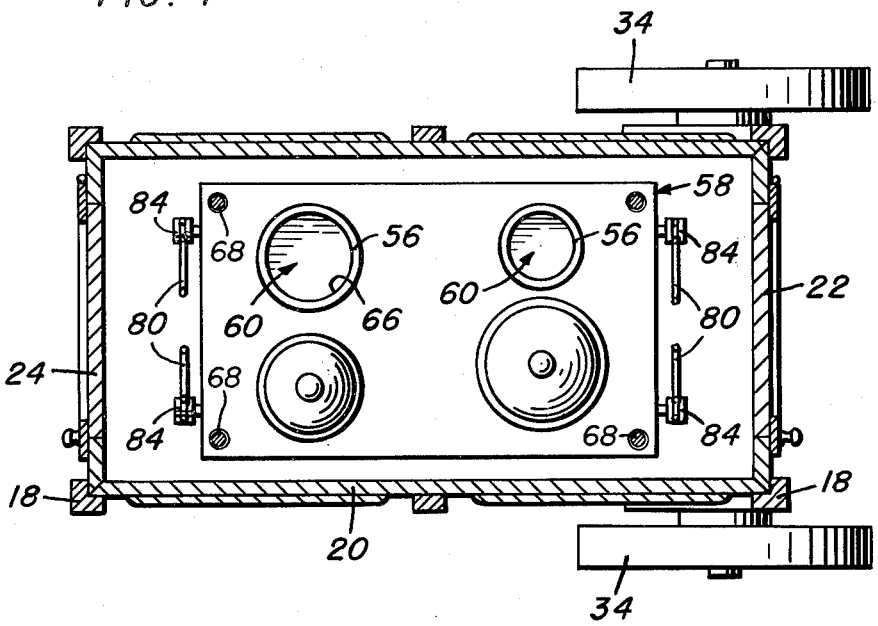
FIG. 4 is a horizontal sectional view taken substantially on line 4—4 of FIG. 2.
Figure 5:
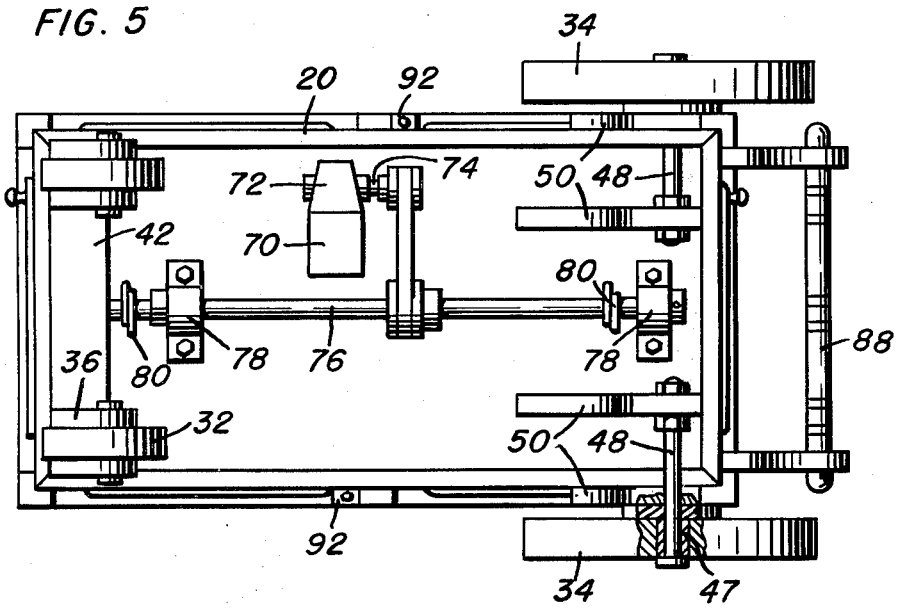
FIG. 5 is a bottom plan view.

The shelf 58 includes a series of upwardly opening pockets 60 therein which correspond in position and general size to the overlying serving top openings 54. These pockets are particularly adapted to receive and stabilize the lower portions of the articles. In actual construction, the shelf 58 is in the nature of a shallow rectangular box having an imperforate lower panel 62 and an upper panel 64 with article receiving openings 66 therethrough. It is these openings 66, in conjunction with the imperforate lower panel 62, which define the article receiving pockets. The distance between the lower and upper panels 62 and 64 is such so as to provide for a stabilizing reception of the various articles while at the same time allowing for a free introduction and removal of the articles as desired. As will be appreciated from FIGS. 2 and 4 in particular, the shelf 58 is rectangular and slightly smaller in overall length and width than the overlying serving top 14 so as to enable a reception of the shelf 58 within the cart housing 16 and the desired vertical movement thereof, as well as provide storage areas at each end of the housing.

In order to stabilize and guide the shelf 58 during the vertical movement thereof, as well as when oriented in the raised or lowered positions thereof, four vertically extending guide rods 68 are provided. These guide rods 68 have the upper and lower ends thereof respectively affixed to the undersurface of the serving top and the upper surface of the base panel 26, with each guide rod 68 passing through one corner portion of the support shelf 58. If deemed desirable so as to enable a smooth guiding of the shelf 58 along the four corner-positioned guide rods 68, appropriate bushings may be utilized.

The actual vertical shifting of the shelf 58 is to be effected automatically using, preferably, a battery powered motor 70 mounted on the under surface of the base panel 26. An appropriate speed reducer mechanism 72 will be associated with the motor and will incorporate an output shaft 74 for a pulley driving of an elongated control shaft 76. The control shaft 76 is also mounted on the lower surface of the base panel by appropriate journals 78.

Affixed to each end portion of the control shaft 76 is a pair of cables 80 which diverge upwardly through the overlying base panel 26. The diverging cables 80 at each end extend vertically immediately outward of the corresponding end of the support shelf 58 and pass over a pair of pulleys 82 affixed to and depending from the undersurface of the serving top 14. The cables then extend substantially vertically downward and engage about a second pair of pulleys 84 affixed to the corresponding end of the support shelf 58. Finally, the cables extend upwardly again and are anchored, as at 86, to the undersurface of the serving top 14. In this manner, it will be appreciated that as the control shaft 76 is rotated so as to wind the cables 80 thereon, the support shelf, with the bottles, ice bucket, and the like, will be elevated so as to extend upwardly through the serving top. By the same token, upon a reverse rotation of the shaft, the cables 80 will unwind therefrom and the support shelf 58, along with the articles thereon, will lower by gravity.

As will be appreciated from the drawings, the pulleys 82 and 84, as well as the cable anchor 86 are, in each instance, positioned closely adjacent the corresponding vertical guide rods 68, thus facilitating a cooperation between the guide rods and the means effecting the actual raising and lowering of the shelf 58.

For ease of operation, it is preferred that the motor be a reversable motor with the control switch therefrom located at a readily accessible position. As will be appreciated from the drawings, it is contemplated that an enlarged control handle 88 be provided for moving and manipulating the cart. This handle will be affixed to one end of the cart with the control switch for the motor (not shown) preferably being located approximately 2 to 3 inches from the corner near the handle on top 14 to afford some protection against accidental activation.

As previously indicated, another important feature of the serving cart 10 of the present invention is the provision of means for effectively enlarging the upper serving surface thereof, particularly at the point of service, while at the same time retaining the relatively compact nature of the cart for movement thereof through narrow doorways and the like. The enlarged serving surface is achieved by the provision of a pair of full length leaves 90, one hingedly affixed along each side edge of the serving top. These leaves 90, in the stored position, are coplanar and overlie the serving top 14 so as to provide a solid support surface for the cart 10 and at the same time "close" the openings 54. In use, the leaves pivot upwardly and outwardly to a position substantially coextensive with the serving top to provide a serving area which substantially increases that of the basic serving top 14 itself.

The support of each leaf in its extended position is effected by a support bar 92. Each support bar 92 slidably mounts within a box-like track 94 affixed to the undersurface of the serving top 14 with the corresponding side panel 20 of the housing 16 having an opening therein of a size sufficient only so as to allow for the extension and the retraction of the support bar.

When fully retracted beneath the serving top 14, both support bars 92 will be substantially completely within the laterally confines of the serving top and housing. When extended, the support bars 92 will sufficiently underlie the respective leaves so as to provide a stable support therefor. Incidentally, as will be appreciated, the support bars 92 and tracks 94 therefor are laterally offset relative to each other whereby both can be accommodated beneath the serving top 14.

Appropriate projections or handles 96 can be provided on each of the support bars 92 so as to facilitate the manipulation and positioning thereof. With specific reference to the box-like tracks 94, each can be provided with a longitudinally extending bottom slot 98 therein having closed ends. The associated support bar 92 can, in turn, have a depending projection 96 on the inner portion thereof which extends through the associated slot 98. In this manner, the projection 96 will act as both a guide for a smooth inward and outward sliding of the support bar 92, and also as a means for limiting the outward movement of the support bar. A similar projection 96 can depend from the outer end of each of the support bars so as to constitute the handle means by which the support bar is manipulated.

While not specifically illustrated, the hinge means mounting the leaves can be such so as to also allow a selective positioning of the leaves in a downward stored position along the opposed sides of the housing. Further, while a battery powered motor is preferred, line power might also be used.

From the foregoing, it will be appreciated that a highly unique serving cart has been defined. This cart incorporates all of the conventional desirable features of such carts, including maneuverability, adaptability to pass freely through narrow spaces, doorways, hallways, and the like, and the provision of a full height serving top. In addition to these normally expected features, the serving cart of the present invention provides a substantially enlarged serving surface at the upper end thereof, means for securely retaining bottles, ice buckets, and similar articles or containers during the movement of the cart from one area to another, means for effectively storing the various articles within an enclosed housing, and means for automatically positioning the bottles, containers or the like for use at the point of serving.

It is to be appreciated that changes and modifications may be made with regard to various details of construction without departing from the broader concepts of the invention. It is thus intended that such modifications and variations fall within the scope of the invention as set forth in the following claims.

I claim:

1. A serving cart comprising a serving top, a base including wheel means, vertical supports extending between said base and said top, a carrying shelf for bottles and containers positioned between said base and said top, and means for vertically adjusting said shelf relative to said top, said top having a plurality of separate openings defined therethrough for selective projection of the bottles and containers through said openings for direct access thereto when the shelf is vertically adjusted upward toward said top, said shelf including interconnected parallel upper and lower panels, said lower panel comprising a support surface for the bottles and containers, said upper panel having a series of openings therein receiving, positioning, and stabilizing the bottles and containers supported on the lower panel and projecting upwardly through the upper panel openings, said means for vertically adjusting said shelf comprising self-contained power means, including a battery powered motor, mounted on said base, and a control system extending from said power means to said shelf for a selective vertical movement of the shelf in response to activation of the power means, said control system includes an elongated shaft rotatably mounted on said base and driven by said motor, said shaft extending centrally and longitudinally of said base, said shaft having opposed end portions, a pair of flexible members affixed to each end portion of the shaft, each pair of flexible members, outward of the corresponding end of the carrying shelf, extending vertically to and about a series of pulley members affixed respectively to the undersurface of the serving top and the corresponding end of the carrying shelf, whereby rotation of the elongated shaft in a first direction will effect a winding of the flexible members thereon and a corresponding elevation of the carrying shelf, a rotation of the shaft in the opposite direction will effect an unwinding of the flexible members therefrom and a gravitational lowering of the carrying shelf, said serving cart further including an extension leaf hingedly mounted along each edge of the serving top and selectively moveable between a first position overlying the serving top, and a second position pivoted upward and outward so as to generally parallel the serving top, and means for releasably supporting each leaf in its outwardly swung position comprising a support bar, and a track mounted beneath the serving top and receiving said bar for a selective extension thereof outward so as to at least partially underlie the outwardly positioned leaf.

2. The serving cart of claim 1 including low upwardly projecting rims provided on said top about the openings defined through the top.

* * * * *